United States Patent [19]

Wilczewski et al.

[11] 3,944,155

[45] Mar. 16, 1976

[54] RIBBON SPOOL

[75] Inventors: Robert Hugh Wilczewski, Riverton, Wyo.; Rudolf Karl Schaefer, Des Plaines, Ill.

[73] Assignee: Victor Comptometer Corporation, Chicago, Ill.

[22] Filed: Apr. 22, 1974

[21] Appl. No.: 462,969

[52] U.S. Cl. ..... 242/74

[51] Int. Cl.[2] ..... B65H 75/28

[58] Field of Search ..... 242/74, 74.1, 197–199, 242/68.3

[56] References Cited

UNITED STATES PATENTS

| | | | |
|---|---|---|---|
| 2,510,475 | 6/1950 | Kuhlik | 242/68.3 |
| 3,386,680 | 6/1968 | Moussie | 242/74.1 |
| 3,495,787 | 2/1970 | Wallace | 242/199 |
| 3,661,345 | 5/1972 | Ritz, Jr. et al. | 242/199 |
| 3,837,599 | 9/1974 | Souza | 242/199 |

*Primary Examiner*—Leonard D. Christian
*Attorney, Agent, or Firm*—McCaleb, Lucas & Brugman

[57] ABSTRACT

One piece ribbon spool molded from suitable plastic, with no fastening hardware with spool or on ribbon required, comprising spaced circular side guide flanges, a central cylindrical hub joined by radial ribs with ribbon-receiving segmental cylindrical wall, a female ribbon latch forming a hook for receiving free end of a male ribbon latch to anchor end of ribbon therebetween, other end of male latch forming unitary hinge connection, and outer surfaces of latches when in ribbon-anchoring position describing extension of cylindrical surface of segmental ribbon-receiving wall, the male latch being narrower than the space separating the side flanges, and apertures in the latter opposite the latches to facilitate engagement and disengagement of the ribbon and the spool.

3 Claims, 3 Drawing Figures

RIBBON SPOOL

BACKGROUND OF THE INVENTION

1. Field of the Invention

This invention relates generally to spools for inking ribbons for use in business machines and equipment, such as adding machines, calculating machines, cash registers, printing computers and typewriters.

2. Description of the Prior Art

Ribbon spools heretofore have been made up of several parts, such as metal stampings, with an end of the ribbon specially constructed for fastening to the spool. For example U.S. Letters Pat. No. 2,600,409 employs metal stampings staked together and having an end loop riveted on the ribbon for engagement over an anchoring ear struck inwardly from one of the side discs, and U.S. Pat. No. 2,652,918 discloses several forms of anchoring members secured to the end of the ribbon to be moved laterally into the interior of the hub through an aperture in one side disc and a peripheral slot in the hub, with a locking lever pivotally mounted on the side disc to close that disc aperture.

SUMMARY OF THE INVENTION

The present invention comprises an inexpensive one piece ribbon spool molded from suitable plastic which does not require any fastening hardware nor any anchoring means on the ribbon, but is readily and easily connected to and disconnected from the ribbon. This one piece construction has spaced circular side guide flanges, a central cylindrical hub and a ribbon-receiving segmental cylindrical wall spaced outwardly therefrom. Ribbon anchoring means comprises a female latch forming a hook for receiving the free end of a male latch to anchor an end of the ribbon therebetween. The other end of the male latch comprises a unitary hinge construction, with the male latch being narrower than the space between the side flanges and the two latches having outer surfaces, when in ribbon-anchoring position, disposed in the cylindrical plane of the segmental ribbon-receiving wall. The side guide flanges preferably have apertures opposite the ribbon anchoring latches to facilitate attachment and removal of the ribbon. This design of the spool lends itself to automatic assembly with a ribbon, and it can be manufactured in a single step at a low cost.

DESCRIPTION OF THE PREFERRED EMBODIMENT

Figure 1:
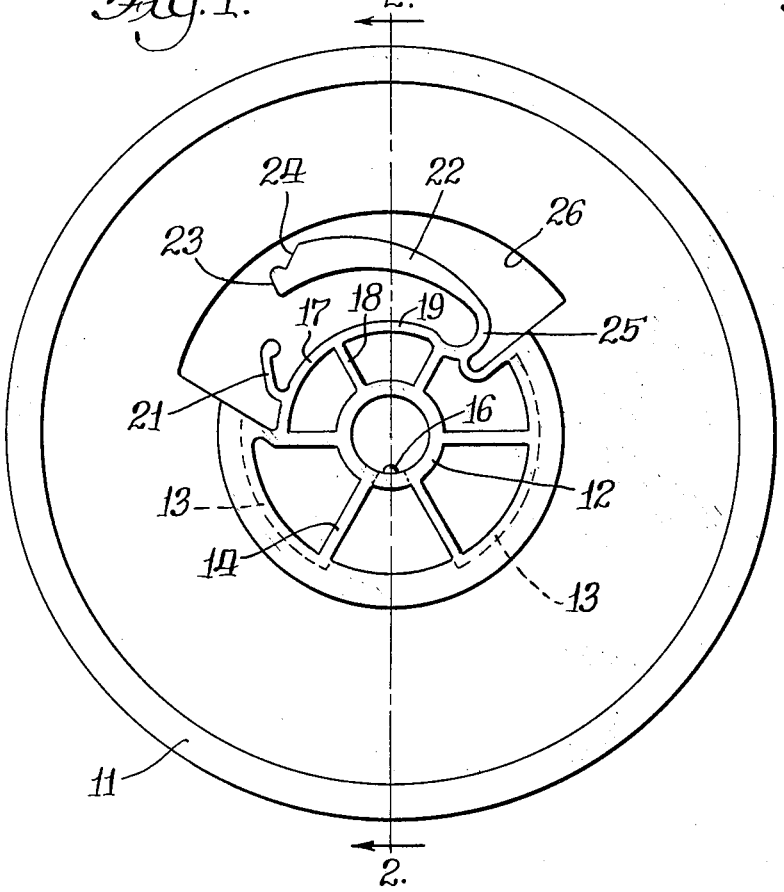
FIG. 1 is a side view of a ribbon spool embodying the invention before mounting of a ribbon thereon.

The ribbon spool of this invention is a one piece molding of a suitable plastic having a pair of parallel circular side guide flanges 11 terminating centrally in, and joined by, a hollow cylindrical hub 12. A segmental cylindrical wall 13, preferably in two sections, extends between the flanges 11 and is spaced radially outwardly from, and is joined with, the hub 12 by a plurality of radial ribs 14. The outer peripheral surface of the wall 13 defines part of a cylindrical ribbon-receiving surface upon which an inking ribbon 15 (FIG. 3) is to be wound. The interior of the hub or spool retainer beam

12 is provided with an inwardly extending nub or protuberance 16 to facilitate snap-fitting of the spool on a ribbon post (not shown).

The leftmost rib 14 (viewing FIGS. 1 and 3) joins the lower end of a segmental cylindrical wall 17 of smaller diameter than the ribbon-receiving wall 13 which is connected to the hub 12 by radial ribs 18 that are shorter than the ribs 14. The outer peripheral surface of the wall 17 defines a ribbon-clamping surface 19 in connection with a hook-shaped female ribbon latch 21 and a male ribbon latch 22 comprising ribbon anchoring means. The lower or inner end of the female latch 21 joins the wall 17 and its free outer end cooperates with the free end of the male latch 22 which, as shown best in FIG. 1, has a camming nose 23 and an upper transverse notch 24. The other end of the male latch 22 is reduced in cross section, reentrantly curved and joins the upper end of wall 17 to provide a strong but readily flexible hinge portion 25. To facilitate freedom of hinged movement of the male latch 22 from its open position of FIG. 1 to its ribbon-anchoring position of FIG. 3, it is made narrower than the space between the side flanges 11, as seen in FIG. 2. The side flanges 11 are provided with apertures 26 which give ready access to the ribbon anchoring means or latches 21, 22. Acetal homopolymers constitute suitable plastics for molding this one piece ribbon spool, one of which is designated by E. I. DuPont de Nemours & Co., Inc. as DELRIN 500.

Figure 2:
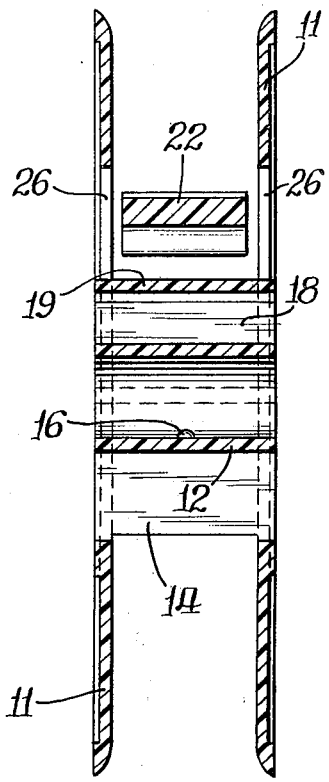
FIG. 2 is a transverse section taken substantially on the line 2—2 of FIG. 1.
Figure 3:
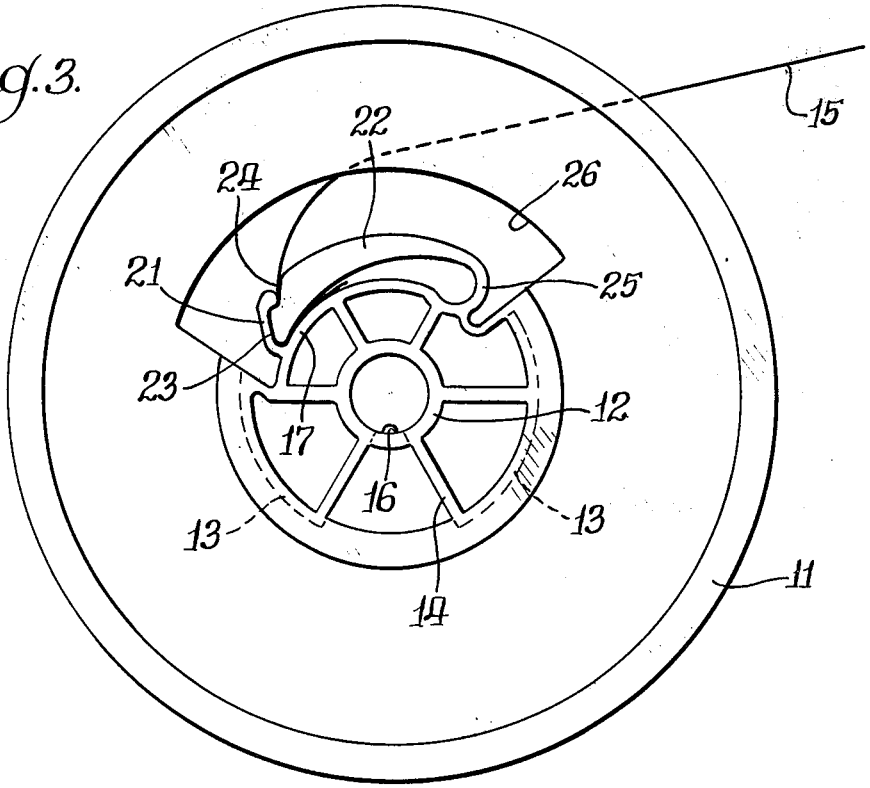
FIG. 3 is a side view like FIG. 1 showing an end of a ribbon secured to the spool.

In operation or use, the male latch 22 is moved to its open position of FIG. 1, an end of the ribbon 15 is dropped or inserted between the side guides 11 and the free ends of latches 21 and 22, and the free end of the latter pushed inwardly to its latched position of FIG. 3. As the male latch 22 is moved into engagement with the female latch 21, the nose 23 will cammingly cooperate with the free end of 21 to move the free ends of the latches away from each other, the final portion of inward movement of latch 22 permitting the hooked nose of 21 to latchingly engage the notch 24 as shown in FIG. 3 to trap and anchor the end of the ribbon 15. As seen in FIG. 3, it is preferred that enough of the end portion of ribbon 15 initially was inserted as to result in its terminal part being clamped between latch 22 and the wall 17. Such insertion is facilitated by first rotating the spool 90 degrees from its position of FIG. 1. In any event, the end of the ribbon is effectively anchored by the latches 21, 22 without requiring any fastening means on the ribbon or hardware of any kind on the spool.

In the ribbon anchoring position of FIG. 3, it will be seen that the outer surfaces of the male latch 22 and the free end of the female latch 21 lie in the cylindrical plane comprising an extension of the outer surface of the segmental cylindrical wall 13 to provide a smooth surface around which the ribbon may be wound. When a ribbon has been unwound from the spool, it is a simple matter to spring the outer end of the female latch 21 away from the notch 24 by reaching through one or both of the apertures 26 to permit the male latch 22 to swing outwardly to its normal release position of FIG. 1 to release the previously anchored end of the ribbon.

It is thought that the invention and many of its attendant advantages will be understood from the foregoing description, and it will be apparent that various changes may be made in the form, construction, and arrangement of the parts without departing from the spirit of the invention or sacrificing all of its material advantages, the form hereinbefore described and shown in the drawings being merely preferred embodiments thereof.

We claim:

1. A one piece plastic spool for an inking ribbon, comprising a pair of parallel side guide flanges, a central cylindrical hub, a segmental cylindrical wall spaced outwardly from said hub interconnecting said side flanges and having a ribbon-receiving peripheral surface, and ribbon anchoring means including a male latch having one end forming a reentrantly curved flexible hinge integral with said wall and a free end, and a female latch forming a hook for receiving said free end of said male latch to anchor an end of said ribbon therebetween, wherein said latches when in ribbon-anchoring position have their outer surfaces disposed as extensions of said peripheral surface of said segmental cylindrical wall, said male latch is narrower than the space between said side flanges and each of said side flanges is provided with an aperture opposite said ribbon anchoring means to facilitate attachment and removal of said ribbon.

2. In a ribbon spool according to claim 1, radial ribs joining said hub, said segmental cylindrical wall, said female latch and said flexible hinge end of said male latch.

3. In a ribbon spool according to claim 1, a radial protuberance extending inwardly from and formed integrally with said central cylindrical hub to effect snap-fit mounting of said spool on a post.

* * * * *